US005575158A

United States Patent [19]

Vogel

[11] Patent Number: 5,575,158

[45] Date of Patent: Nov. 19, 1996

[54] REFRIGERATION DEFROST CYCLES

[75] Inventor: Kenneth E. Vogel, Yuma, Ariz.

[73] Assignee: Russell A Division of Ardco, Inc., Brea, Calif.

[21] Appl. No.: 318,214

[22] Filed: Oct. 5, 1994

[51] Int. Cl.[6] ..... F25B 47/02

[52] U.S. Cl. ..... 62/196.4; 62/278; 62/156

[58] Field of Search ..... 62/81, 156, 151, 62/196.4, 197, 199, 200, 278, 505

[56] References Cited

U.S. PATENT DOCUMENTS

| | | | |
|---|---|---|---|
| 2,443,500 | 6/1948 | Goddard | 62/278 X |
| 3,464,226 | 9/1969 | Kramer | 62/278 X |
| 4,049,410 | 9/1977 | Miller | 62/197 |
| 4,193,781 | 3/1980 | Vogel et al. . | |
| 4,356,703 | 11/1982 | Vogel . | |
| 4,437,317 | 3/1984 | Ibrahim | 62/196.4 X |
| 4,625,524 | 12/1986 | Kimura et al. | 62/278 |

*Primary Examiner*—Harry B. Tanner
*Attorney, Agent, or Firm*—Knobbe, Martens, Olson & Bear

[57] ABSTRACT

A hot gas defrost system for a refrigeration cycle, including at least one compressor, condenser, receiver, expansion valve and evaporator. During defrost, a pressure-sensitive valve to the condenser inlet is normally closed, and the flow of refrigerant from the compressor bypasses the condenser and flows to the receiver. However, when the pressure in the system reaches a critical point, the pressure-sensitive condenser inlet valve will open to release the excessive pressure. The condenser inlet valve is also temperature-sensitive and will open if the ambient temperature surrounding the condenser is above a specific point. Opening of the condenser valve permits the utilization of the hot gas in the condenser for defrost and to decrease the thermal shock resulting from the superheated vapor contacting the evaporator coil. The compressor, which needs a constant flow of liquid refrigerant for cooling, is continually supplied with liquid refrigerant. During refrigeration, a conduit connecting the receiver outlet and the compressor provides liquid refrigerant. During defrost, a conduit from the suction line to the compressor provides the required liquid refrigerant. The system also provides complete defrosting and deicing of the evaporator coil. A bypass line between the hot gas inlet of the evaporator and the lower section of the evaporator coil directs a portion of the hot gas directly to the lower section of the coil.

9 Claims, 2 Drawing Sheets

FIG. 2
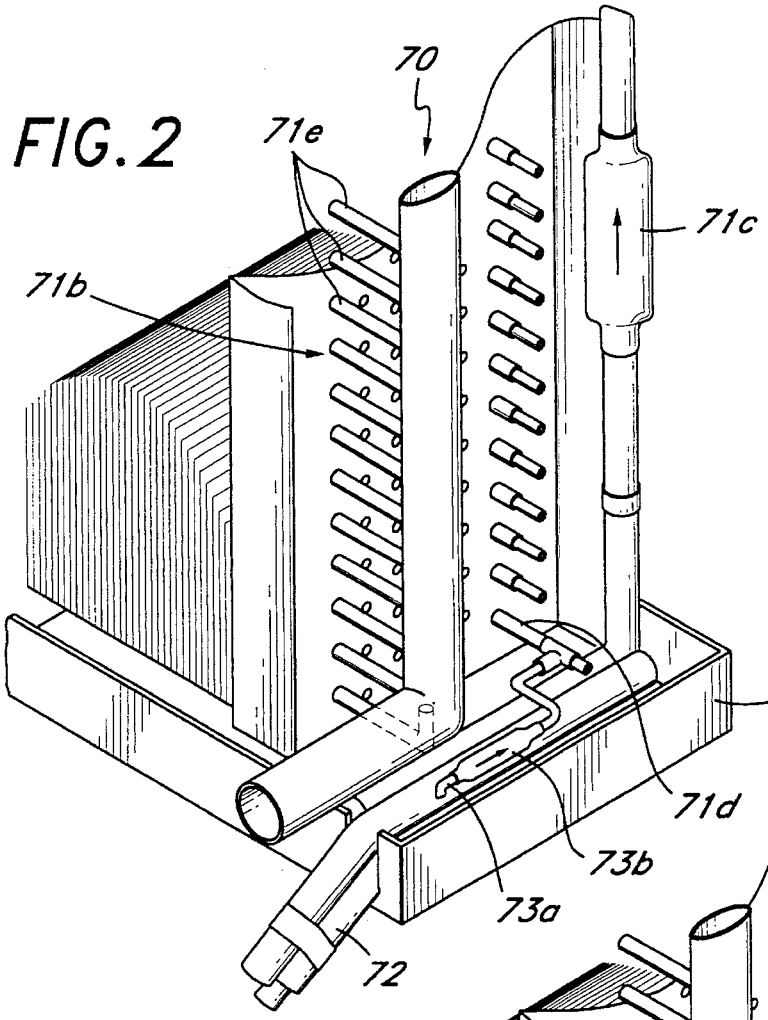
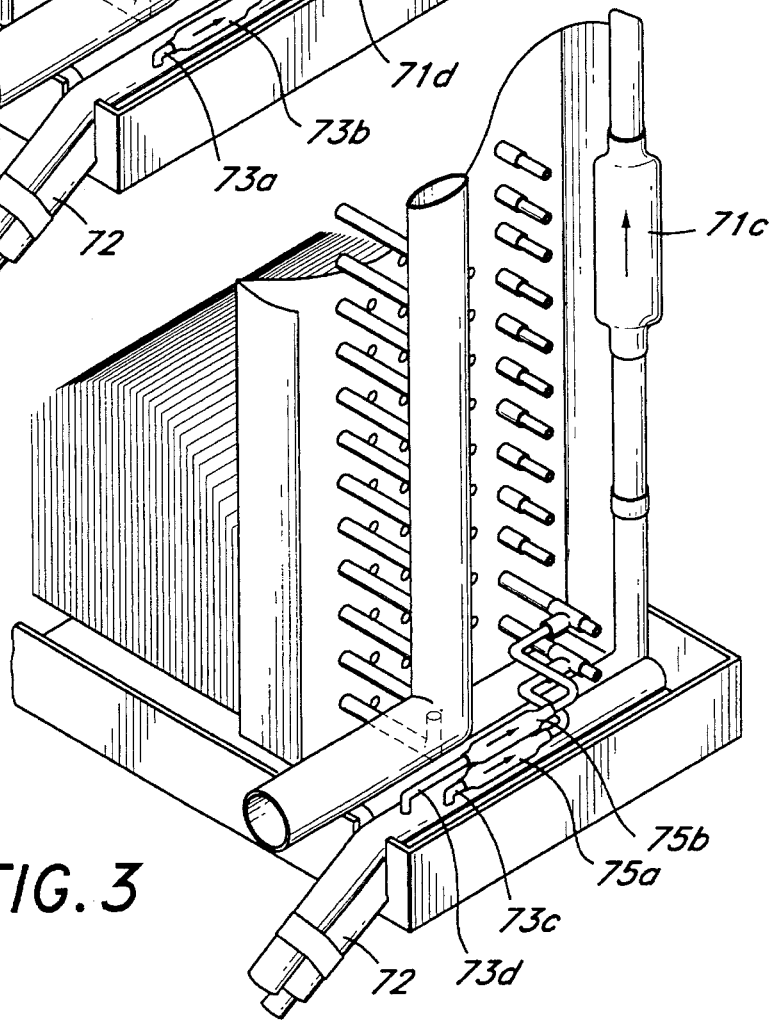
FIG. 3

REFRIGERATION DEFROST CYCLES

FIELD OF THE INVENTION

The present invention relates to refrigeration systems and, more particularly, to a refrigeration system having a system for periodic defrosting of the evaporator by hot gaseous refrigerant.

BACKGROUND OF THE INVENTION

Conventional mechanical refrigeration systems provide gaseous refrigerant to a compressor. The compressor discharges the gaseous refrigerant under substantial pressure to a condenser where the compressed gas is cooled and condensed into a liquid. The liquid refrigerant flows from the condenser to a receiver where the liquid is accumulated. The liquid then travels from the receiver to an expansion valve where the pressure upon the liquid is decreased. The refrigerant, now at low temperature and pressure, flows into an evaporator. In the evaporator, the refrigerant absorbs heat from the space to be refrigerated. This heat absorption transforms the liquid into a gas. The gaseous refrigerant is then drawn through a suction line to the compressor where it is again compressed and the above-described cycle repeated.

Conventional refrigeration equipment employs various arrangements for periodic defrosting of the evaporator in order to maintain the evaporator free from the accumulation of ice or frost. Such devices typically incorporate a bypass line so that hot gas refrigerant discharged from the compressor bypasses the condenser and travels directly to the receiver. The hot gas exits the receiver, bypasses the expansion valve, and enters the evaporator. The hot gas, as it travels through the evaporator, melts the accumulation of frost or ice on the evaporator coil. A single conduit is commonly used during defrost and refrigeration, i.e., a single conduit carries liquid during refrigeration and hot gas during defrost.

In more detail, a typical hot gas defrost system closes a valve at the inlet to the condenser. This forces all the hot gaseous refrigerant produced by the compressor to bypass the condenser and to flow directly into the receiver. The pressure of the hot gas entering the receiver forces all the liquid out of the receiver and into a conduit leading towards the evaporator. The pressure provided by the compressor then forces the hot gas out of the receiver and into the conduit towards the evaporator. The evaporator generally contains two inlets, a liquid inlet used during refrigeration and a hot gas inlet used during defrost. During defrost, a valve on the liquid inlet to the evaporator closes and a valve on the hot gas inlet opens. This forces the hot gas to flow through the hot gas valve and into the hot gas inlet of the evaporator. The hot gas then traverses the distributor and the evaporator coil. The heat from the hot gas is conducted and transferred to the evaporator coil. This warms the coil and, in turn, melts the ice or frost. This process also condenses the gaseous refrigerant into a liquid. The liquid refrigerant then flows through the evaporator outlet and into a suction line to the compressor. During defrost, a valve closes on the suction line and forces the liquid refrigerant into a branch line. The branch line may contain a holdback valve, accumulator, or other such device to limit the pressure at the compressor inlet. Limiting the pressure at the compressor inlet is necessary to prevent the compressor inlet pressure from overloading the compressor. The liquid in the branch valve is then reheated into a gas. The gas is then returned to the compressor and the defrost cycle can be repeated.

SUMMARY OF THE INVENTION

It is desirable to improve and simplify the currently used hot gas defrost system for refrigeration cycles. For example, it will be readily appreciated that large pressures often develop within the system. During defrost, the compressor expels compressed hot gas into the system. The hot gas travels through the system and is condensed into a liquid. In one common approach, the liquid accumulates behind a holdback valve in order to prevent excessive pressure at the compressor inlet. While this may limit the pressure at the compressor inlet, it causes the pressure to build within the other portion of the system. Therefore, as defrost continues, pressure increases behind the holdback valve. If the pressure becomes excessive at the compressor outlet, the compressor will malfunction.

The present invention, in one preferred embodiment, provides a means for releasing excessive pressure in the system during defrost by installing a pressure sensor at the compressor outlet. This pressure sensor measures the pressure at the compressor outlet. The pressure sensor is coupled to the discharge solenoid valve located at the condenser inlet. The discharge solenoid valve is normally closed during defrost. When pressure nears the point at which the compressor will malfunction, the pressure sensor signals the discharge solenoid valve to open. The opening of the discharge solenoid valve releases refrigerant into the condenser, decreasing the pressure within the system. This permits continuous defrosting without compressor malfunction due to excessive back pressure.

Typical hot gas defrost systems divert the flow of hot gas into a condenser bypass during defrost to eliminate the flow of refrigerant through the condenser. It will be appreciated that this common approach contains several deficiencies. First, these known systems fail to use the hot gas contained within the condenser for defrosting purposes. This is inefficient and wastes a heat source because the hot gas in the condenser can be utilized during defrost. Second, the hot gas provided by the compressor is a superheated vapor. Severe thermal shock occurs when the superheated vapor enters the evaporator coil because of the extreme temperature difference between the superheated vapor and the evaporator coil. The contact of the superheated vapor with the frost and ice encrusted evaporator coil causes rapid thermal expansion. This sudden thermal expansion can cause breaks and leaks of the evaporator coil.

In a preferred form of the present invention, the discharge solenoid valve is coupled to a temperature sensor located near the condenser. This temperature sensor measures the ambient temperature of the air surrounding the condenser. If the ambient temperature is above a specific point, then the discharge solenoid valve at the condenser inlet remains open during defrost. Therefore, the superheated vapor continues to flow through the condenser. A check valve in the condenser bypass prevents the flow of superheated vapor through the condenser bypass line whenever the discharge solenoid valve is open. The pressure in the condenser is much lower during defrost because the thermal expansion valve is bypassed. The superheated vapor entering the condenser is merely cooled, and not condensed into a liquid, because of the elevated temperature surrounding the condenser and the low pressure in the condenser. In sum, the combination of high ambient temperature and low pressure allows the superheated vapor to be cooled in the condenser to diminish the problems of thermal shock by decreasing the temperature difference between the hot gas entering the evaporator and the evaporator coil. In addition, this embodiment permits all the hot gas contained within the condenser to be used to defrost the evaporator.

Currently, refrigeration cycles commonly use R502 as a refrigerant in low temperature applications. However, because of concerns about ozone depletion, government regulations have phased out or eliminated the use of some refrigerants. R502 is being eliminated as a refrigerant. Refrigerants such as R22 will now be used in low temperature refrigeration systems. While systems using R22 have been developed, there are certain problem areas which can result in faulty operations.

A typical compressor in a refrigeration system using R22 requires a constant supply of liquid refrigerant, according to the compressor manufacturer 's specifications. The R22 circulating within a refrigeration system normally contains oil, which is used to lubricate the system. If the refrigerant reaches a specific temperature, the oil may burn or char. The compressor uses the liquid R22 as a source of coolant. Previous systems that use R22 disclose a conduit from the receiver outlet to the compressor. This conduit transports the required liquid R22 to the compressor by connecting the receiver outlet to the condenser. Liquid R22, however, only flows from the receiver outlet during refrigeration. Hot gas flows from the receiver during defrost. Thus, known systems do not provide liquid R22 to the compressor during defrost.

According to a preferred embodiment, the invention provides liquid R22 to the compressor at all times, including during defrost. The invention contains the previously described conduit from the receiver outlet to the compressor. The present invention also has a novel connection between the suction line exiting the evaporator and the known line connecting the receiver outlet and the compressor. The suction line, which carries gaseous refrigerant from the evaporator outlet to the compressor inlet during refrigeration, carries liquid refrigerant during defrost. This new conduit is used to provide liquid refrigerant to the compressor during defrost.

Common hot gas defrost systems also fail to completely remove the ice and frost from the evaporator coil. As the hot gas travels into the hot gas inlet of the condenser and through the coil, heat transfers from the gas to the coil. This decreases the temperature of the refrigerant, which decreases its ability to melt the ice or frost. In fact, the refrigerant of known systems may be sufficiently cooled that the melting of the ice and frost is prevented. Frost and ice act as an insulator and decreases the efficiency of the system. Layers of ice and frost can build-up during the periodic defrosting. These layers of ice and frost can damage or crush the evaporator coil.

A preferred embodiment of this invention prevents damaging or crushing of the evaporator coil by ensuring complete removal of the frost and ice. One or more bypass lines connect the hot gas inlet of the evaporator to lower sections of the evaporator coil. The bypass lines allow a limited flow of hot gas directly to lower sections of the coil. Thus, refrigerant that has been cooled by flowing through the distributor and the upper section of the coil is joined by hot gas from the bypass line at the lower section of the coil. This provides the necessary increase in the refrigerant temperature to ensure complete defrosting and deicing of the entire evaporator coil.

OBJECTS OF THE INVENTION

In view of the foregoing, it is an object of the present invention to provide a valve at the condenser inlet which is capable of opening during defrost to reduce the pressure within the system.

Further, it is an object of the present invention to provide a valve at the condenser inlet which remains open during defrost when the ambient temperature surrounding the condenser is above a specific point.

It is a still further object of the present invention to provide a source of liquid refrigerant to the compressor during defrost.

It is also an object of the present invention to completely defrost or deice the evaporator coil by providing one or more bypass lines which direct a portion of the hot gaseous refrigerant to the lower section of the evaporator coil.

Consistent with the foregoing objects, and in accordance with the invention as embodied and broadly described herein, a novel means of an improved hot gas defrost for refrigeration systems.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

FIG. 2 is a schematic drawing illustrating a preferred embodiment with a single bypass line connecting the hot gas inlet of the evaporator and the lower section of the evaporator coil.

FIG. 3 is a schematic drawing illustrating a preferred embodiment with dual bypass lines connecting the hot gas inlet of the evaporator to lower sections of the evaporator coil.

DETAILED DESCRIPTION OF THE PREFERRED EMBODIMENT

Figure 1:
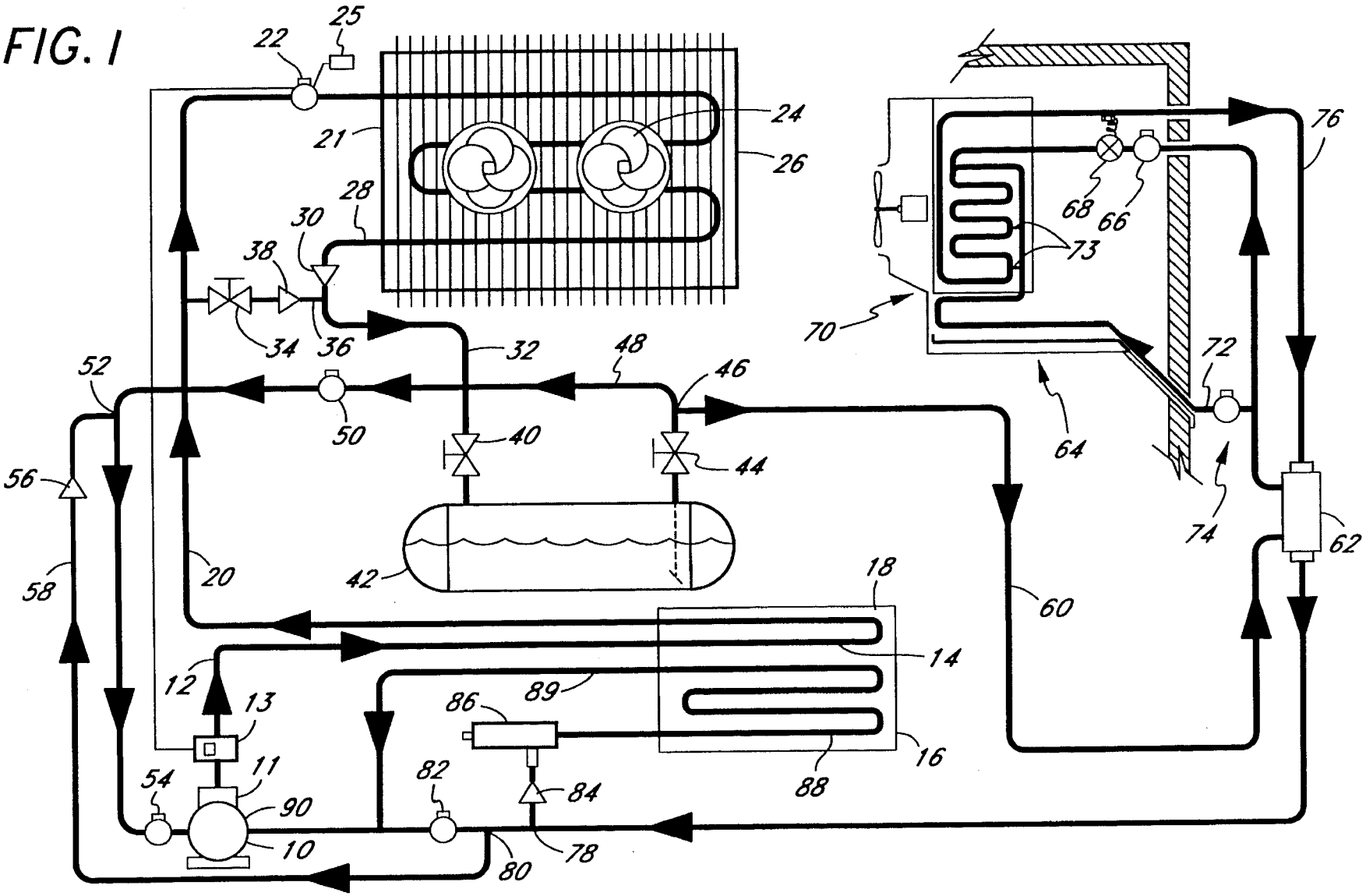
FIG. 1 is a schematic drawing illustrating one presently preferred embodiment of the present invention of the hot gas defrost for a refrigeration system.

It will be readily understood that the components of the present invention, as generally described and illustrated in the figures herein, could be arranged and designed in a wide variety of different configurations. Thus, the following more detailed description of the embodiment of the present invention, as represented in FIGS. 1–3, is not intended to limit the scope of the invention, as claimed, but it is merely representative of the presently preferred embodiment of the invention.

In FIG. 1, during refrigeration, compressor 10 delivers refrigerant vapor at high pressure and temperature into discharge line 12. The gas traverses heating coil 14 within heat exchanger 16. Heat exchanger 16 is typically a liquid filled heat storage wherein the hot gas heats liquid 18 within heat exchanger 16. The gas exits heat exchanger 16 and proceeds through conduit 20 toward condenser 26.

The gas traverses discharge solenoid valve 22 at condenser inlet 21 and enters condenser 26. Condenser 26 has one or more condenser fans 24. Condenser 26 is typically air cooled and is located outdoors and exposed to ambient temperature. Condenser 26 has no controls associated with it for reducing or modulating its capacity during refrigeration. After the refrigerant is condensed to a liquid in condenser 26, the liquid flows out of condenser outlet 28, condenser check valve 30, and into condenser conduit 32.

Closed condenser bypass valve 34 prevents refrigerant from flowing into condenser bypass 36 from conduit 20. Condenser bypass check valve 38 prohibits refrigerant from entering condenser bypass 36 from condenser conduit 32.

The liquid refrigerant flowing through condenser conduit 32 enters receiver inlet valve 40 and collects within receiver 42. The liquid is withdrawn from receiver 42 via receiver outlet valve 44. Receiver outlet tee 46 then divides the liquid flowing from receiver outlet valve 44. A portion of the liquid enters compressor liquid line 48 and traverses demand cooling feed solenoid valve 50. This liquid proceeds through compressor liquid line 48 and compressor liquid line tee 52 to injection solenoid valve 54. Check valve 56 prevents the flow of liquid into liquid suction line 58. Injection solenoid valve 54 controls the rate of liquid refrigerant entering compressor 10.

The other portion of the liquid flows through evaporator liquid line 60 and thermolater 62 to evaporator 64. The liquid traverses liquid solenoid valve 66, thermal expansion valve 68, and distributor 70. No liquid enters evaporator 64 through hot gas inlet 72 because hot gas solenoid valve 74 is closed during refrigeration. Within evaporator 64, liquid refrigerant absorbs heat and is transformed into gas. The gas is then returned to compressor 10 through suction line 76, thermolater 62, holdback line tee 78, suction line tee 80, suction solenoid valve 82, and compressor inlet 90. No gas travels through liquid suction line 58 because of inherent pressure gradients within the system, since the pressure in suction line 76 is lower than the pressure in compressor liquid line 48. Holdback check valve 84 is spring-loaded and is adjusted so that no refrigerant passes through holdback check valve 84 during refrigeration. The gas traversing suction solenoid valve 82 then enters compressor inlet 90 and the cycle can be repeated.

During defrost, the following events occur if the ambient temperature surrounding condenser 26 is below a specific temperature, such as seventy degrees Fahrenheit. Compressor 10 discharges hot gas through discharge line 12, heating coil 14, and conduit 20. Temperature sensor 25 measures the ambient temperature of the air surrounding condenser 26. If the temperature is below the specific point, the discharge solenoid valve 22 at condenser inlet 21 closes and condenser bypass valve 34 opens. Because discharge solenoid valve 22 is closed, hot gas cannot enter condenser 26. The hot gas must instead traverse open condenser bypass valve 34 and push open condenser bypass check valve 38. Spring-loaded condenser bypass check valve 38 is constructed with an internal spring which requires a pressure of approximately 14PSI to allow flow through condenser check valve 38. Condenser check valve 30 prevents hot gas from entering condenser 26 via condenser outlet 28.

The pressure of the gas entering receiver 42 pushes the liquid in receiver 42 through receiver outlet valve 44. Demand cooling feed solenoid 50 closes during defrost and prevents the flow of hot gas through compressor liquid line 48. Therefore, all the hot gas traverses evaporator liquid line 60. Hot gas solenoid valve 74 opens during defrost while liquid solenoid valve 66 closes. Consequently, the hot gas flows through the open hot gas solenoid valve 74, bypasses thermal expansion valve 68, and enters hot gas inlet 72 of evaporator 64. The hot gas traverses evaporator check valve 71*c*, evaporator pan 71*a c*, distributor 70, and evaporator coil 71*b*. The hot gas, while defrosting and deicing the components within evaporator 70, dissipates heat and is condensed into a liquid. The liquid exits evaporator 64 by means of suction line 76. Suction solenoid valve 82 on suction line 76 closes during defrost. Suction line tee 80 in suction line 76 allows a portion of the liquid to flow through liquid suction line 58, check valve 56, compressor liquid line tee 52 and into compressor liquid line 48. Closed demand cooling feed solenoid 50 prevents liquid from flowing into receiver outlet valve 44 or evaporator liquid line 60. This causes the liquid in liquid suction line 58 to flow into injection solenoid valve 54 and compressor 10. Liquid suction line 58 therefore provides the necessary liquid refrigerant to compressor 10 during defrost.

The other portion of the liquid travels through holdback line tee 78 and holdback check valve 84 to holdback valve 86. Holdback valve 86 allows a limited amount of refrigerant, at a limited pressure, to flow into re-evaporating coil 88. Re-evaporating coil 88 is immersed in warmed liquid 18 contained within heat exchanger 16. Liquid 18 has been warmed by the continual flow of gas through heating coil 14. The liquid refrigerant traversing re-evaporating coil 88 absorbs heat from heat exchanger 16 and is transformed into a gas. The gas is drawn from re-evaporating coil 88, through conduit 89, and into compressor inlet 90. Holdback valve 86 is adjusted so that the pressure at compressor inlet 90 is such that compressor 10 can tolerate the pressure without overloading.

If the ambient temperature surrounding condenser 26, measured by temperature sensor 25, is as above a specific temperature such as seventy degrees Fahrenheit, the previously described defrost cycle occurs with the following changes. Discharge solenoid valve 22 at condenser inlet 21 remains open and condenser bypass valve 34 remains closed. This forces the hot gas provided by compressor 10 to traverse condenser 26. The hot gas travelling through condenser 26 is cooled, but because of the high ambient temperature surrounding condenser 26 and the low pressure within condenser 26, the refrigerant is merely cooled and not condensed into a liquid. The gas within condenser 26 is at a low pressure because thermal expansion valve 68 is bypassed during defrost. This results in temperature decrease of the gas, but not condensing of the gas. The remainder of the defrost cycle is the same as the previously described defrost cycle at ambient condenser temperatures below the specific temperature.

FIG. 1 illustrates another preferred embodiment of the invention where discharge solenoid valve 22 at condenser inlet 21 is pressure controlled. The above-described defrost cycle at ambient condenser temperatures below the specific temperature for the present invention is generally the same, but discharge solenoid valve 22 is coupled to pressure sensor 13 at compressor outlet 11. Pressure sensor 13 measures the back pressure in the system at compressor outlet 11. If this back pressure nears the point at which the compressor will malfunction, pressure sensor 13 signals discharge solenoid valve 22 to open. This allows refrigerant to flow into condenser 26. The periodic opening of discharge solenoid valve 22 acts as a pressure release and prevents compressor 10 from malfunctioning.

FIG. 2 illustrates another preferred embodiment which provides a means to ensure frost or ice on lower section 71*d* of evaporator coil 71*b* is removed. Hot gas enters evaporator 64 through hot gas inlet 72. A first portion of hot gas travels through check valve 71*c* and distributor 70 to evaporator coil 71*b*. This first portion of the hot gas traverses the upper section 71*e* of evaporator coil 71*b*, lower section 71*d* of evaporator coil 71*b*, and exits evaporator 64 via suction line 76. A second portion of the hot gas enters bypass line 73a branching off hot gas inlet 72 connecting to lower section 71d of evaporator coil 71b. Hot gas enters bypass line 73a, traverses check valve 73b, and enters the lower section of evaporator coil 71d. Bypass line 73aallows a portion of the hot vapor to reach lower section 71d of evaporator coil 71b before it is cooled by traversing distributor 70 and upper section 71e of evaporator coil 71b. The hot gas from bypass line 73a mixes with the gas traveling through upper section 71e and warms the flow of refrigerant. This flow of hot gas through bypass line 73a ensures the removal of frost and ice from the lower section of evaporator coil 71b.

FIG. 3 illustrates another embodiment to ensure the removal of frost or ice from lower section 71d of evaporator coil 71b. Hot gas enters evaporator 64 through hot gas inlet 72. A first portion of hot gas travels through distributor 70 and check valve 71c to evaporator coil 71b. This first portion of the hot gas traverses upper section 71e and lower section 71d of evaporator coil 71b and exits evaporator 64 via suction line 76. A second portion of the hot gas enters first bypass line 73c branching off hot gas inlet 72. First bypass line 73c connecting to lower section 71d of evaporator coil 71b to hot gas inlet 72. A third portion of the hot gas enters second bypass line 73d branching off hot gas inlet 72, which connects another section of lower section 71d of evaporator coil 71b to hot gas inlet 72. Hot gas enters first bypass line 73c and second bypass line 73d, and traverses bypass check valves 75a and 75b, respectively. Bypass lines 73c and 73d enter lower sections 71d of evaporator coil 71b. Bypass lines 73c and 73d allow a portion of the hot vapor to reach lower sections of evaporator coil 71b before it is cooled by traversing distributor 70 and the upper section of evaporator coil 71e. The bypass lines 73c and 73d ensure the removal of frost and ice from the lower section 71d of evaporator coil 71b.

I claimed:

1. In a refrigeration system, including a compressor, a condenser, a first conduit connecting the compressor and the condenser, a receiver, an evaporator, and defrost cycle valving for directing hot gasses from the compressor to the receiver while bypassing the condenser and directing liquid and hot gasses from the receiver to a coil in the evaporator to defrost the evaporator coil, apparatus for improving the defrost cycle, comprising:

a valve controlling flow from the compressor to the condenser through said first conduit;

a temperature sensor for sensing the temperature adjacent the condenser, said temperature sensor being coupled to said valve, said valve being responsive to a temperature above a selected temperature to allow the hot gasses from the compressor to flow into the condenser where it is cooled somewhat before traveling to the receiver and the evaporator coil, said valve being responsive to a temperature below said temperature to direct the hot gasses from the compressor to flow to said receiver and the evaporator coil;

a pressure sensor coupled to said valve for permitting output from said compressor to flow into said condenser when the pressure of the refrigerant leaving the compressor reaches a predetermined maximum;

one or more bypass lines for distributing the heated refrigerant to the evaporator coil at two or more points in the evaporator coil to defrost all areas of the evaporator coil; and a second conduit for conducting liquid refrigerant from the evaporator to the compressor to cool the compressor during the defrost cycle.

2. The apparatus of claim 1, wherein said valving includes a solenoid valve controlling the flow of refrigerant from the compresser to the condenser, said solenoid valve being normally closed during the refrigeration cycle and normally closed during the defrost cycle, said temperature sensor being connected to open said solenoid valve at said predetermined temperature, said pressure sensor being connected to open solenoid valve at said predetermined pressure.

3. The apparatus of claim 1, wherein said valving includes a condenser bypass valve which connects the output of said compressor to said receiver, said bypass valve being normally closed during the refrigeration cycle and being normally open during the defrost cycle.

4. The apparatus of claim 1, wherein said valving includes an evaporator bypass valve connected to bypass the expansion valve in the evaporator, said evaporator bypass valve being normally closed during the refrigeration cycle so that refrigerant from the receiver flows into the evaporator expansion valve and being normally open during the defrost cycle so that hot gas from the receiver flows into the evaporator coil and bypasses the expansion valve, and one or more additional evaporator bypass valves for controlling the flow through said bypass lines for distributing the heated refrigerant to the evaporator coil in a manner to defrost all areas of the coil.

5. The apparatus of claim 1, wherein said valving includes a compressor coolant valve for controlling the flow of refrigerant from the receiver to a compressor cooling line, said compressor coolant valve being normally open during the refrigeration cycle so as to receive liquid refrigerant from the receiver and being normally closed during a defrost cycle so as to prevent heated gaseous refrigerant flowing from the receiver to the compressor coolant line, a compressor refrigerant inlet valve for controlling the flow of refrigerant from the evaporator to the compressor inlet, said compressor inlet valve being normally open to permit gaseous refrigerant to flow from the evaporator to the compressor inlet during the refrigeration cycle, and said compressor inlet valve being normally closed during the defrost cycle to prevent liquid refrigerant from flowing to the compressor inlet, said liquid refrigerant from the evaporator being bypassed through a heat exchanger for vaporization before flowing to the compressor inlet line, and a compressor coolant valve for controlling the flow of refrigerant from the evaporator to the compressor coolant line, said compressor coolant valve being normally closed during the refrigeration cycle to prevent the flow of gaseous refrigerant to the compressor coolant line and being normally open during the defrost cycle to permit a quantity of liquid refrigerant from the evaporator to flow to the compressor coolant line.

6. A refrigeration apparatus comprising:

a compressor;

a condenser;

a conduit directing the output of the compressor to the condenser;

a condenser inlet valve which is normally open during a refrigeration cycle and closed during a defrost cycle;

a receiver receiving refrigerant from the condenser;

a condenser bypass valve for allowing output from the compressor to flow to the receiver;

an evaporator receiving refrigerant from the receiver;

a compressor suction line for conducting refrigerant from the evaporator to the compressor; and a temperature sensor for sensing the temperature adjacent the condenser and connected to open said condenser inlet valve during a defrost cycle at a predetermined temperature.

7. The apparatus of claim 6, including a pressure sensor for sensing the pressure of the compressor output, said pressure sensor being connected to open said condenser inlet valve during a defrost cycle when the pressure exceeds a predetermined maximum.

8. A refrigerator apparatus comprising:

a compressor;

a condenser connected to receive the output from said compressor;

a heat exchanger receiving heat from the refrigerant flowing from the compressor to the condenser;

a receiver connected to receive refrigerant from the condenser;

an evaporator connected to receive the output from said receiver with the output from said evaporator being connected to an inlet of said compressor;

a conduit connecting said receiver to a compressor coolant inlet for providing liquid to the compressor for cooling purposes during a refrigeration cycle;

a valve in said compressor coolant line for preventing the flow of hot gasses to the compressor coolant inlet during a defrost cycle;

an inlet valve in the compressor suction line, said compressor inlet valve being normally open during the refrigeration cycle and normally closed during a defrost cycle;

a conduit upstream of said compressor inlet valve directing refrigerant from the evaporator through said heat exchanger and into said compressor inlet downstream from said compressor inlet valve; and a conduit extending between said suction line upstream of said compressor inlet valve to said compressor coolant line for providing liquid coolant to said compressor during a defrost cycle.

9. A method of providing liquid refrigerant to a compressor liquid line of a refrigeration system during a defrost cycle so as to prevent the temperature of refrigerant compressed by the compressor from attaining a temperature which will char or burn a lubricant in the refrigerant, said refrigeration system includes a compressor, a condenser receiving refrigerant from the compressor, a receiver receiving refrigerant from the condenser, an evaporator receiving refrigerant from the receiver, a suction line for conducting refrigerant from the evaporator to the compressor, said method comprising:

closing a compressor inlet valve connected in said suction line during a defrost cycle so that the majority of liquid refrigerant from the evaporator is conducted through a heat exchanger and fed into the compressor inlet downstream from the compressor inlet valve; and conducting a portion of the liquid refrigerant from the evaporator to the compressor liquid line during a defrost cycle and preventing the flow of refrigerant from the evaporator to the compressor liquid line during a refrigeration cycle.

* * * * *